US009255708B2

(12) United States Patent
Wróbel et al.

(10) Patent No.: US 9,255,708 B2
(45) Date of Patent: Feb. 9, 2016

(54) TABLE TEALIGHT HOLDER

(75) Inventors: Andrzej Wróbel, Wieluń (PL); Adam Chudecki, Makrsko (PL); Roman Kotala, Wieluń (PL); Piotr Cieślak, Wieluń (PL); Tomasz Wróbel, Wieluń (PL); Jaroslaw Wolowiec, Wierzchlas (PL)

(73) Assignee: Korona S.A, Wielun (PL)

( * ) Notice: Subject to any disclaimer, the term of this patent is extended or adjusted under 35 U.S.C. 154(b) by 64 days.

(21) Appl. No.: 13/153,048

(22) Filed: Jun. 3, 2011

(65) Prior Publication Data

US 2015/0176835 A1 Jun. 25, 2015

(51) Int. Cl.
*F23D 3/16* (2006.01)
*F21V 35/00* (2006.01)

(52) U.S. Cl.
CPC ..... *F21V 35/00* (2013.01)

(58) Field of Classification Search
CPC ..... F21V 35/00; F23D 3/16; F23D 3/24; F23D 3/18
USPC ..... 431/288–356; 222/377, 328
See application file for complete search history.

(56) References Cited

U.S. PATENT DOCUMENTS

2001/0030203 A1* 10/2001 Weber ..... 222/377
2008/0070174 A1* 3/2008 Moeller ..... 431/289

* cited by examiner

*Primary Examiner* — Kenneth Rinehart
*Assistant Examiner* — Jason Lau
(74) *Attorney, Agent, or Firm* — Mark M. Friedman

(57) ABSTRACT

The table cup-shaped tealight holder according to the invention has the bottom (1) inclined towards the horizontal plane at the angle (C) with the recess (2) located in the central point. There are grooves (3) in the bottom which are connected with the recess (2) and form the angle (B) with the horizontal plane.

1 Claim, 1 Drawing Sheet

A - A

TABLE TEALIGHT HOLDER

BACKGROUND

The object of the invention is a table tealight holder.

There are known table tealight holders with a special construction of the bottom. These holders have special forming at the bottom edge which enables to pile up the holders as in the Community Design No 000364039. There are also known table tealight holders with a bottom convex towards the inner part of the holder as in the Community Design No 000344015 which drains the excess liquid paraffin to the groove along the bottom circumference.

In these holders part of the liquid paraffin remains not used, which with large production of table tealight holders results in a substantial loss.

SUMMARY

The table cup-shaped tealight holder with a groove-shaped forming along the bottom edge, according to the invention, has the bottom with a recess in the centre which is connected with the grooves and the angle formed by the lower groove edge and the horizontal line and the angle between the bottom plane and the horizontal plane ranges from 0 to 60 degrees.

The table tealight holder, according to the invention, allows the liquid paraffin collected at the bottom of the holder in the last burning phase to be used to a larger extent than it has been used so far.

BRIEF DESCRIPTION OF THE DRAWINGS

An example of the object of the invention is shown in a drawing, in which.

DETAILED DESCRIPTION

Figure 1:
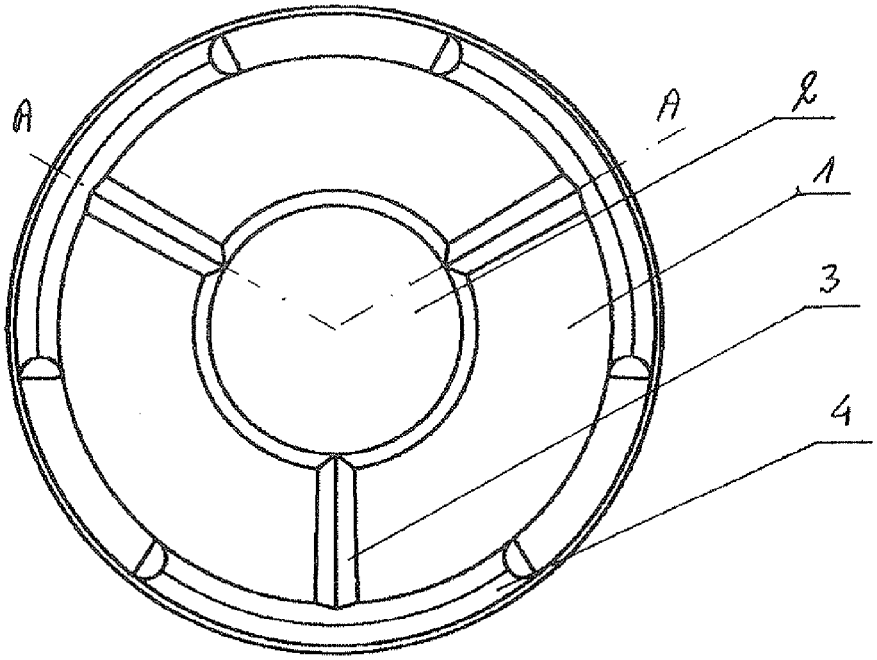
FIG. 1 shows a general view of the table tealight holder as seen from the bottom.
Figure 2:
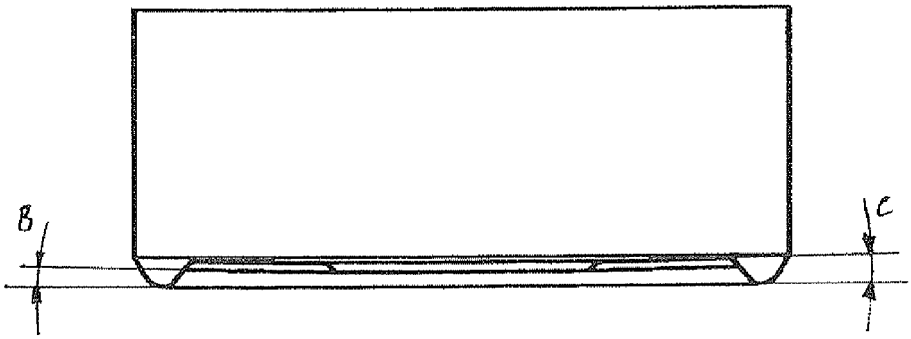
FIG. 2 shows a section along the A-A line of FIG. 1.

The object of the invention as a manufacturing example is presented in the drawing in which FIG. 1 shows the general view as seen from the bottom and FIG. 2 shows the section along the A-A line.

The table cup-shaped tealight holder has a groove-shaped forming 4 along the external bottom edge. In the central point the bottom j__ of the holder formed in the shape of a conical plane the generating angle of which is 1 degree to the horizontal plane has a flat recess 2 in which there is usually a bottom part of a wick. The grooves 3 go down to the recess 2 and connect the recess 2 with the groove 4. The grooves 3 are inclined at the angle of 1 degree towards the bottom surface, which makes the liquid paraffin flow freely to the recess 2 in the final burning process.

We claim:

1. A table tealight holder, the tealight holder having a shape of a cup comprising:

a conical bottom;

a groove-shaped forming along a circumference of a bottom edge of the conical bottom;

a central recess in a central point of the conical bottom;

radial grooves in the conical bottom, the radial grooves connecting the groove-shaped forming and the central recess;

wherein bottom edges of the radial grooves and the conical bottom are inclined with respect to a horizontal line at an angle smaller than 60 degrees thereby facilitating liquid paraffin flow towards the central recess.

* * * * *